United States Patent [19]

Healey

[11] Patent Number: 4,704,962

[45] Date of Patent: Nov. 10, 1987

[54] PRINTING MACHINE

[76] Inventor: Robert Healey, 425 Lajeunesse, Ste. Dorothée, Laval, Que. H7X 1R8, Canada

[21] Appl. No.: 787,078

[22] Filed: Oct. 15, 1985

[51] Int. Cl.[4] ..... B41F 3/04

[52] U.S. Cl. ..... 101/269; 101/45; 101/252; 101/260; 101/DIG. 18

[58] Field of Search ..... 101/269, 270, DIG. 18, 101/252, 271, 272, 273, 274, 45

[56] References Cited

U.S. PATENT DOCUMENTS

| | | | |
|---|---|---|---|
| 8,810 | 5/1835 | Warren | 101/269 X |
| 1,941,448 | 12/1933 | Uhthoff | 101/269 X |
| 3,045,589 | 7/1962 | Hill et al. | 101/269 X |
| 3,233,542 | 2/1966 | Minardi | 101/269 X |
| 3,358,597 | 12/1967 | Barbow et al. | 101/269 |
| 3,388,659 | 6/1968 | Hu | 101/269 |
| 3,410,207 | 11/1968 | Barbour | 191/269 |
| 3,633,505 | 1/1972 | Ferrari | 101/252 X |
| 3,705,548 | 12/1972 | Waterman | 101/269 |
| 3,709,144 | 1/1973 | Sins | 101/269 X |
| 3,739,718 | 6/1973 | Zupancic | 101/269 X |
| 3,768,404 | 10/1973 | Holovka, Jr. | 101/269 |
| 3,800,700 | 4/1974 | McInnis et al. | 101/269 |
| 3,814,015 | 6/1974 | Ozaki et al. | 101/269 |
| 3,818,829 | 6/1974 | Patterson, Jr. | 101/269 |
| 4,044,675 | 8/1977 | Deisting | 101/269 |
| 4,078,491 | 3/1978 | Schweers | 101/269 |
| 4,305,330 | 12/1981 | Ogihara | 101/269 X |
| 4,411,196 | 10/1983 | Kubo | 101/269 |
| 4,425,847 | 1/1984 | Drillick | 101/269 |
| 4,457,228 | 7/1984 | Wittek | 101/269 X |

FOREIGN PATENT DOCUMENTS

| | | | |
|---|---|---|---|
| 759250 | 5/1967 | Canada | 101/269 |
| 953151 | 8/1974 | Canada | 101/269 |
| 953972 | 9/1974 | Canada | 101/269 |
| 954746 | 9/1974 | Canada | 101/269 |
| 993267 | 7/1976 | Canada | 101/269 |
| 633992 | 1/1982 | Switzerland | 101/269 |

*Primary Examiner*—Edgar S. Burr
*Assistant Examiner*—James R. McDaniel
*Attorney, Agent, or Firm*—Larson and Taylor

[57] ABSTRACT

A printing machine that prints on forms or documents from cards having embossed characters thereon takes into account different thicknesses of cards and forms. The machine provides an even pressure downwards. The printing machine comprises a base; a print bed means on the base for holding embossed printing characters facing upwards; an elongate member having a rectangular cross section, the member positioned above, extending across and parallel to the print bed means and supported from the base; roller head carriage on the elongate member and print roller platen supported from the carriage below the elongate member, guide frame within the carriage having roller means for reciprocal movement on the elongate member with restricted tipping and slewing of the guide frame relative to the elongate member; the guide frame attached to the carriage and having restricted upward movement in one place relative to the carriage, and spring bias means pressing the guide frame upwards in the one plane, pushing the print roller platen in the carriage against the embossed characters on the print bed means and maintaining substantially even printing pressure for varying thickness of forms.

16 Claims, 9 Drawing Figures

PRINTING MACHINE

The present invention relates to printing machine and more specifically the present invention relates to a printing machine of the kind where impressions are reproduced on forms or documents by rolling on a roller platen across the face of a form or document which is placed over a surface having embossed characters thereon.

Manual and electrically operated printing machines for many kinds and types of credit cards, medical cards, bank cards, etcetera are available today. Most of these printing machines, however, are designed to print on a form having a specific thickness and form an embossment on a card or the like, with a specific height. Thus, a printing machine which is suitable for printing from one type of card may not print clearly from a different type of card. Furthermore, if a paper from a document was of a different thickness, it might not fit under the roller platen, or may not print legibly. In this day and age when stories and businesses accept many different types of credit cards, a problem arises as to finding a printing machine which can utilize all these credit cards. Another problem is in the use of medical cards where hospitals sometimes have to print forms from two or three different cards having different thicknesses.

Most existing printing machines exert a certain pressure on the form or document to be printed, and as the form has a standard thickness or similar number of copies, and the embossed height on the card is also standard, the machine prints satisfactorily. Most print cards have embossed characters with a height of 0.018 inches and this seldom changes. However, as soon as the thickness of the form or number of copies changes, or as soon as the thickness of the card changes, then the roller platen must move to a different position and either no printing occurs, or the print is illegible. Furthermore, if the thickness of the card and form is too great, then the pressure on the forms from the roller platen is so high that it is difficult for an operator to move the printing head carriage across the form. Another problem that occurs when the pressure from the roller platen is too high, is that the embossed characters on a plastic card are crushed which damages the card so it cannot be used in other printing machines.

One purpose of the present invention is to provide a printing machine that attempts to overcome all the above mentioned problems occurring with existing printing machines. It is an aim of the present invention to provide a printing machine that can print different thicknesses of forms from different thicknesses of print cards. It is a further aim of the present invention to provide a printing machine that provides an even pressure from the roller platen on the form when rolling over the embossed printing characters regardless of the thickness of paper forms or thickness of print card.

A still further aim of the present invention is to provide a printing machine that may easily be modified to hold many different embossed cards of different thicknesses and can be fitted with templates, masks or guides to allow the customer to change the card position by choosing the right template when the paper form or document is changed or redesigned. It is another aim to be able to use two cards on a print bed, the cards having different thicknesses and yet be able to reproduce the characters from both cards on one or more forms with equal print intensity.

The present invention provides a printing machine for printing on forms of varying thickness from a surface having embossed characters thereon comprising a base; print bed means on the base for holding embossed printing characters facing upwards; elongate member having a rectangular cross section, the member positioned above, extending across and parallel to the print bed means and supported from the base; roller head carriage positioned about the elongate member for reciprocal movement thereon; print roller platen supported from the carriage beneath the elongate member, adapted to roll over the embossed printing charcaters on the print bed means when the carriage moves along the elongate member; guide frame within the carriage having roller means for reciprocal movement on the elongate member with restricted tipping and slewing of the guide frame relative to the elongate member; the guide frame attached to the carriage and having restricted upward movement in one plane relative to the carriage; and spring bias means pressing the guide frame upwards in the one plane, pushing the print roller platen in the carriage against the embossed characters on the print bed means, and maintaining substantially even printing pressure for varying thickness of forms. In a preferred embodiment, the roller means in the guide frame has two end stabilizer plates with four guide rollers positioned therebetween, two of the guide rollers rolling on top of the elongate member and the other two of the guide rollers rolling underneath the elongate member, the four guide rollers restricting tipping of the guide frame relative to the elongate member, and side guide rollers positioned axially on and at each end of the four guide rollers adjacent the elongate member, the side guide rollers restricting slewing of the guide frame relative to the elongate member.

In other embodiments of the invention, the print bed means has at least one open sided template to accomodate a card having embossed characters thereon, the template permitting the card to be slid into a fixed position for printing, the spring bias means maintaining substantially even printing pressure for different thicknesses of cards. In another embodiment a slide cover slides over edges on the base, and the cover has at least one cut-out for holding a card having embossed characters thereon. Adjustable stops may be attached to the base for providing a guide for positioning a form.

The elongate member can be supported at both ends or can be cantilevered from one end. In one embodiment the elongate member is supported at both ends and is pivoted to allow the roller head carriage and the elongate member to be swung open.

The operation of the roller head carriage may be manual or motorized to provide a reciprocal movement. In the case of a motorized unit, a cover is supplied to protect the mechanism and a tripping means is provided on the cover to activate the motorized unit.

In drawings which illustrate embodiments of the invention;

Figure 1:
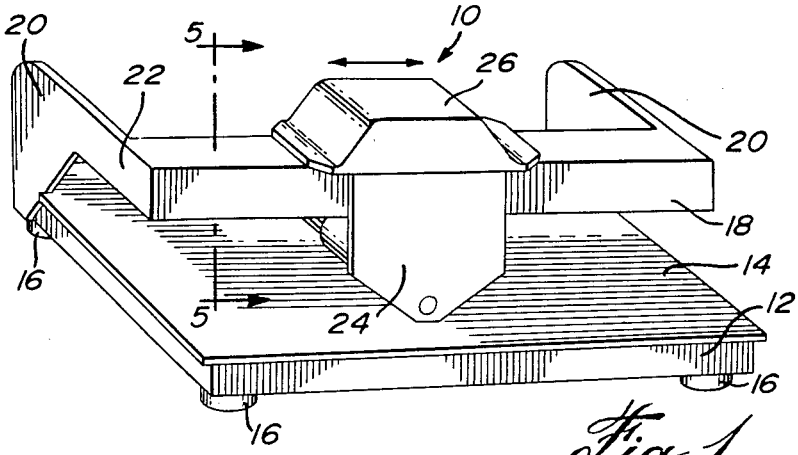
FIG. 1 is an isometric view showing one embodiment of a printing machine according to the present invention.

One embodiment of a printing machine 10 is shown in FIG. 1 having a base 12 with a top plate 14 thereon representing a print bed. Details of the manner in which embossed characters are mounted on or secured to the print bed 14 will be explained hereafter. The base 12 has four rubber suction mounts 16 which stop the base 12 from moving when printing occurs. These rubber mounts 16 are not essential, but are preferred. Other devices may be provided to hold or lock the printing machine in a fixed location.

An elongate member 18 is positioned above the print bed 14 parallel to the print bed and extending across the base 12 from one side to the other. The elongate member 18 has a rectangular cross section and in a preferred embodiment is a square tube. Support plates 20 at both ends of the elongate member 18 hold the member 18 rigidly to the base 12. The support plates 20 have an arm 22 that is substantially parallel to the base 12 and then extends down to the corner of the base 12 thus providing access forms and the like to be inserted from the side or straight through from the front to the back of the print bed 14. A roller head carriage 24 is mounted on the elongate member 18 and is able to reciprocate on the elongate member 18. Details of the roller head carriage 24 will be explained hereafter. A handle 26 is mounted on top of the roller head carriage 24 for manual operation.

Figure 2:
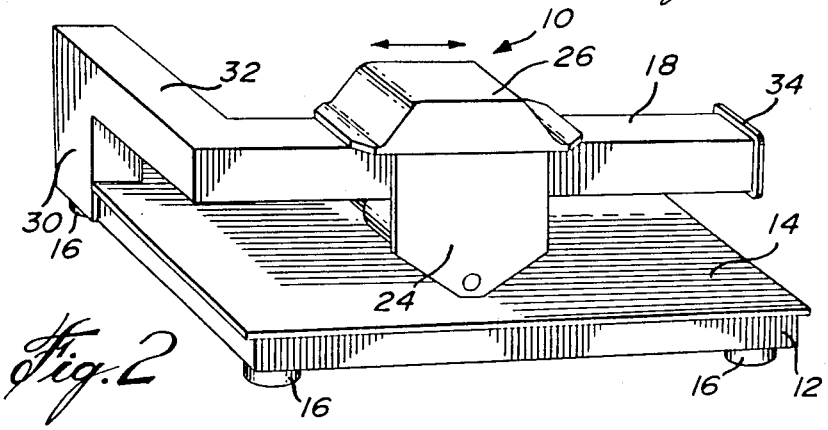
FIG. 2 is an isometric view showing another embodiment of a printing machine.

FIG. 2 illustrates another embodiment of a printing machine wherein the elongate member 18 is cantilevered from one side. This provides a printing machine which has a single post 30 extending from one corner of the base 12, and a support arm 32 which in turn is formed integral with the elongate member 18. In the embodiments shown, the post 30, support arm 32 and elongate member 18 are all made from square tube material of the same size and welded together so that the elongate member 18 is rigidly held in the position above the print bed 14. A stop 34 is provided on the open end of the elongate arm 18 to prevent the roller head carriage 24 from being pushed off the elongate member 18.

Figure 3:
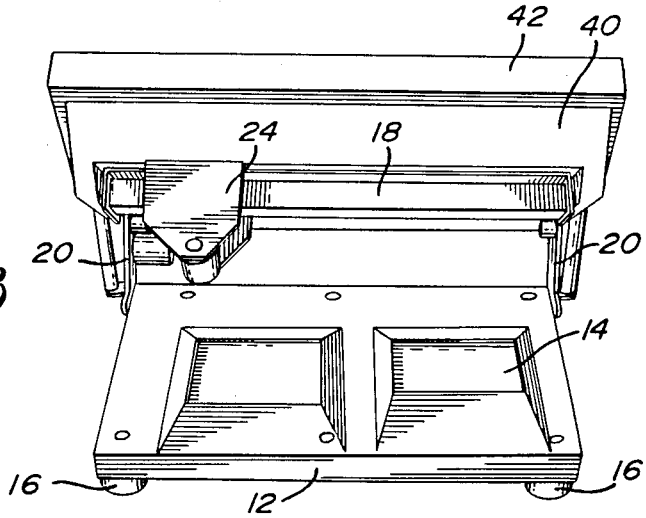
FIG. 3 is an isometric view showing a motorized version of a printing machine according to the present invention with the elongate member and roller head carriage pivoted open.
Figure 4:
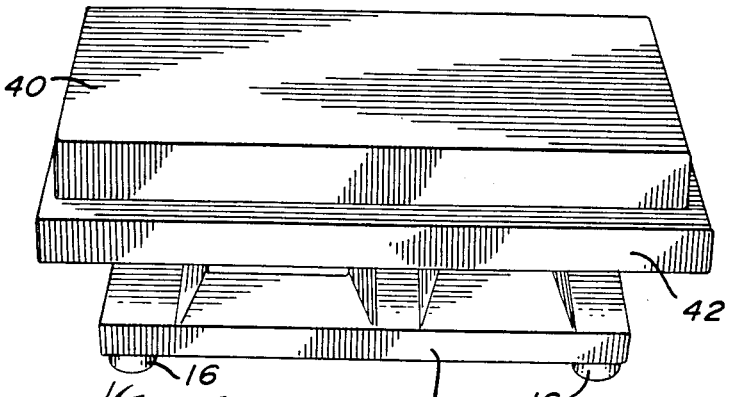
FIG. 4 is an isometric view showing the motorized printing machine as shown in FIG. 3 with the elongate member and roller head carriage in the closed position ready for printing.

FIGS. 3 and 4 illustrate a motorized printing machine in comparison with the manually operated printing machine shown in FIGS. 1 and 2. In the case of the motorized unit, the elongate member 18 is supported at both ends by support plates 20 and the support plates are pivoted at the corners to the base 12. Thus the assembly of elongate member 18 and roller head carriage 24 may be pivoted open for ease of inserting plates and forms for printing. FIG. 3 illustrates the elongate member 18 and roller head carriage 24 pivoted open and FIG. 4 shows the assembly in the closed position ready for printing. A lock may be provided to hold the assembly in the closed position, however, a lock is not essential, and printing can occur in the locked or unlocked position. Details of the drive mechanism will be shown hereafter. The movement of the roller head carriage 24 may be set by limit switches or stops so that it extends for a portion of the length of elongate member 18 or for the full length depending on the type of printing and form required. The motorized unit has a cover 40 protecting the motorized drive mechanism with an activating lever 42 at the front of the cover which activates the drive and the roller head carriage 24 reciprocates across the print bed 14. Pushing down on the activating lever 42 ensures a solid contact between the support plates 20 and a stop positioned on the base 12. While printing, the print roller platen moves upwards in the roller head carriage 24 above the print bed 14. The elongate member 18 does not pivot open while printing occurs. It is not necessary to lock the elongate member 18 and roller head carriage 24 assembly in the print position although a lock is provided for transportation purposes and for continuous printing. An interlock is also provided so that the printing sequence does not take place until the elongate member 18 and roller head carriage 24 assembly are in the printing position.

Figures 5, 6, 7:
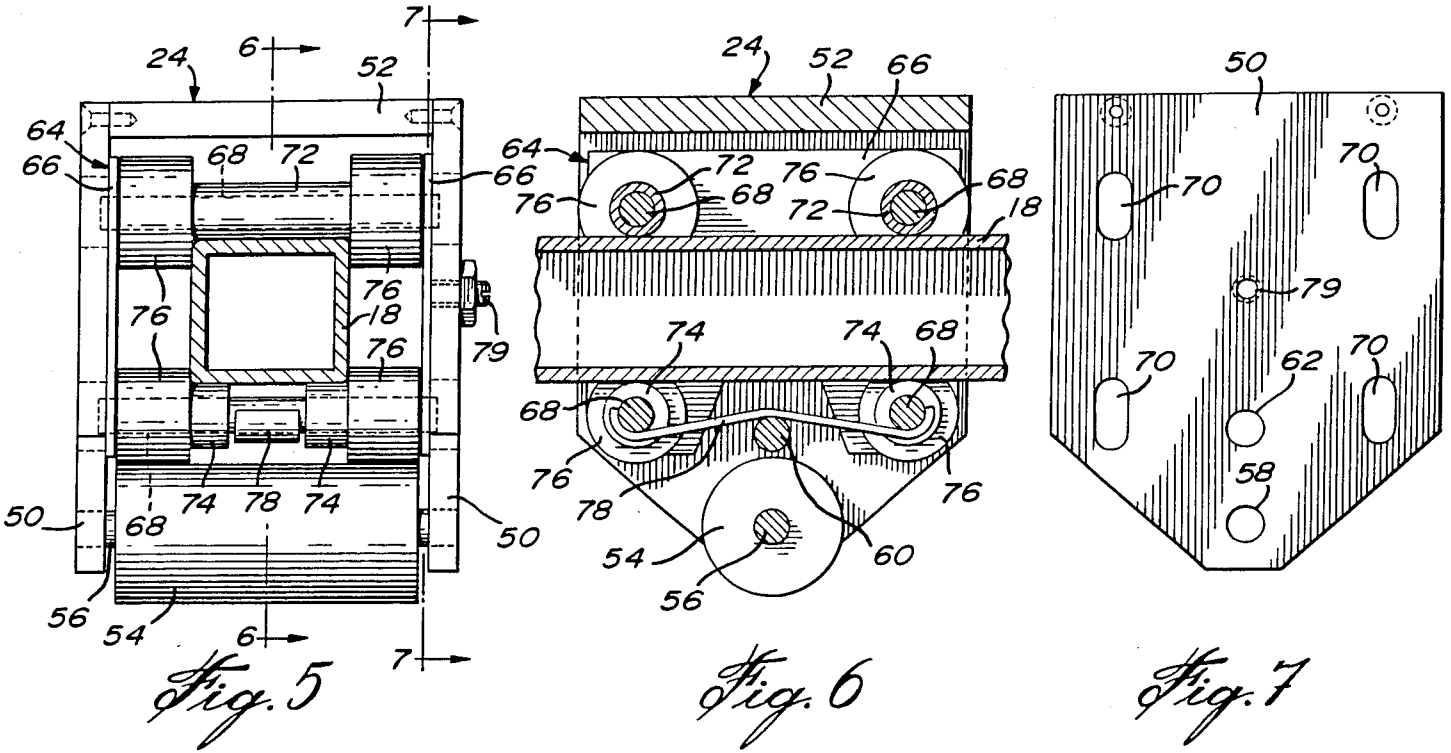
FIG. 5 is a sectional view of a roller head carriage taken at line 5—5 of FIG. 1.
FIG. 6 is a sectional view taken at line 6—6 of FIG. 5.
FIG. 7 is a sectional view taken at line 7—7 of FIG. 5.

Details of the roller head carriage are shown in FIGS. 5, 6 and 7. The carriage 24 has two end plates 50 joined together at the top by a top plate 52. A print roller platen 54 is supported at the bottom of the two end plates 50 on a shaft 56 extending from two holes 58 in the end plates 50. The print roller platen 54 may be impregnated with ink, or may be formed from a resilient material with no ink thereon. When an ink impregnated platen 54 is used, it rolls over a form or forms on top of the embossed characters on the print bed 14 and leaves ink where the embossed characters push the form upwards. For a non-inked platen 54, the paper forms are sensitive to pressure, or have a layer of carbon or other pressure printing layer therein, so the embossed characters are highlighted. A spring shaft 60 extends between the two end plates 50 just above the print roller platen 54 and is held in place by socket screws through holes 62.

A guide frame 64 is positioned inside the roller head carriage 24 about the elongate member 18. The guide frame 64 has two end stabilizer plates 66 adapted to be positioned adjacent the insides of the two end plates 50 of the carriage 24. The stabilizer plates 66 both have four round holes therein arranged substantially in a square to hold the roller shafts 68. Each roller shaft 68 has both ends extending through the two stabilizer plates 66 into vertical slots 70 provided on the insides of the two end plates 50 of the carriage 24. The four end slots 70 provide restricted linear movement in one plane for the guide frame 66. Two top guide rollers 72 on the two upper roller shafts 68 roll on the top surface of the elongate member 18, and two bottom guide rollers 74, which are shown in two halves with a space therebetween, roll on the edges of the bottom surfaces of the elongate member 18, thus the elongate member 18 fits precisely within the guide rollers 72 and 74 and prevents the guide frame 64 from being tipped when it moves on the elongate member 18. Side guide rollers 76 are provided on each of the four shafts 68 positioned at the sides and having a diameter larger than the guide rollers 72 and 74. The side guide rollers 76 have their edges running against the vertical sides of the elongate member 18 and thus restrict slewing action between the guide frame 64 and the elongate member 18. A leaf spring 78 passes over the spring shaft 60 and under the two lower shafts 68 between the guide rollers 74 and biases the whole guide frame 64 upwards within the housing 24. Inasmuch as the only movement that can occur between the guide frame 64 and the housing 24, is the restricted linear movement due to the slots 70, there can be no tipping or slewing action for the roller head carriage 24 relative to the elongate member 18. When pressure occurs on the print roll platen 54, it has provisions to rise up against the leaf spring 78 with the guide roller shafts 68 sliding in the slots 70 of the end plates 50. However, the downward pressure on the print roll platen 54 remains substantially the same throughout the whole movement of the guide frame 64 within these slots 70. A set screw 79 and lock nut are fitted through one of the end plates 50, so the stabilizer plates 66 can be adjusted for distance apart, ensuring side guide rollers 76 are the correct distance apart to restrict slewing.

Figure 8:
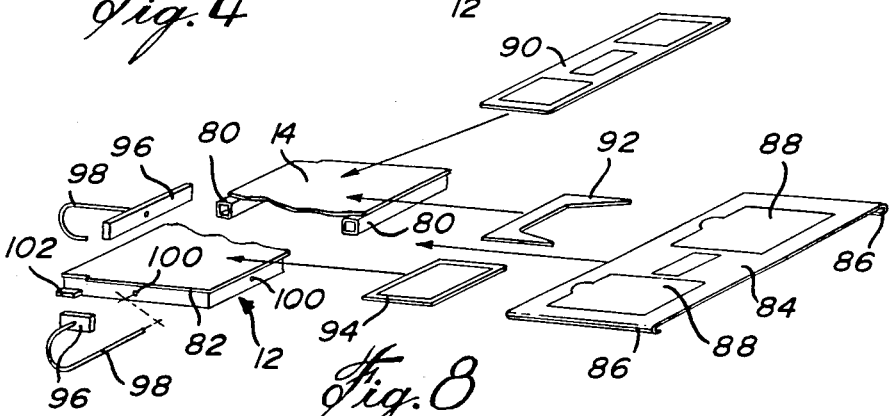
FIG. 8 is an isometric exploded view, partially in section, showing the base and print bed of a printing machine with various templates, masks and guides to hold embossed cards.

As shown in FIG. 8, the base 12 is preferably made from square tube sections 80 welded together at the corners. The dimension of the square tube sections 80 in one embodiment is substantially the same dimension as the elongate tube 18. The print bed 14 is attached to the square tubes 80 and has lips 82 at both sides for a slide cover 84 with wrap around edges 86. The lips 82 act as guides for the cover 84. Cut-outs 88 may be provided in the cover 84 for cards having characters embossed thereon. FIG. 8 shows two cut-outs 88 for two separate cards with a smaller cut-out in the center which can be used for a date or numbering system. The date or numbering system can be incorporated into the base in a known manner. Various covers 84 may be made available, and if it is desirous of changing the position of the card, the form to be printed, or the shape and dimension of the card, then a different cover 84 can be slipped over the print bed plate 14. A double mask 90 having the same cut-outs as the cover 84 is shown. This double mask 90 may be made from sheet metal, plastic sheet or other suitable material and glued or otherwise attached to the print bed plate 14. An open sided template 92 is also shown for mounting on the print bed plate 14. The template 92 accomodates a card having embossed characters thereon and permits the card to be slid into a fixed position on the print bed plate 14. Similarily a further template or mask 94 is shown for attaching to the print bed plate 14.

Guides or stops 96 for forms or documents have a U-shaped elongate member 98 which fit into holes 100 in the square tube 80 of the base 12, and allow different sizes of forms to be positioned to suit the print bed 14. Whereas back and side stops 96 are shown, it will be apparent that front guides and stops can also be provided. Most print cards are made of plastic and have embossed characters with a height of 0.018 inches. Paper thicknesses vary from 0.0005 up to 0.040 inches and in some cases, a form can have several sheets of paper with carbons in between. Most plastic print cards vary in thickness from 0.018 to 0.030 inches and the present invention takes a variation in thickness of credit card. The height of the embossed characters can be more or less than the norm. It has been found that up to 20 sheets of paper may be used on the printing machine of the present invention and still obtain a legible print of the characters on the top sheet. In one embodiment, the elongate member 18 is twelve inches long and provides a roller head carriage movement of nine and a half inches. This distance is sufficient for two cards and a rotary date change stamp in between.

The masks and guides as shown in FIG. 8 may be formed of metal or plastic. They may be glued or in other ways attached to the print bed plate 14. In one embodiment, magnetic clips are used to position the mask or guide, however, these should not be used with a print card having a magnetic strip thereon, as it may erase the magnetic code on the card. Plastic clips may be glued to the print bed plate 14 or onto a cover plate 84 as shown in FIG. 8.

A stop 102 is formed integral with the base 12 on the opposing back corners. The stop provides a solid contact in the embodiment wherein the elongate member 18 is pivoted. The two support plates 24 are pivoted upwards to open the machine, but the stops 102 provide a solid position for printing.

Figure 9:
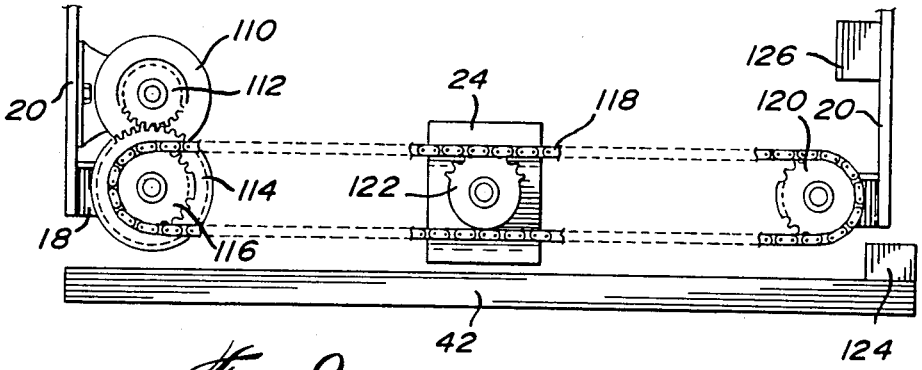
FIG. 9 is a schematic view of the electric motorized drive for the printing machine shown in FIGS. 3 and 4.

Details of the drive mechanism are shown in FIG. 9 wherein a gear motor 110 attached to one support arm 20 has a pinion 112 which drives a gear 114. A sprocket 116 attached to gear 114 moves a drive chain 118 backwards and forwards from a fixed sprocket 120 at the other end of the elongate member 18. Another sprocket 122 with a clutch mechanism therein is attached to the roller head carriage 24. In operation the gear motor 110 drives the roller head carriage backwards and forwards on the elongate member 18. The safety clutch on sprocket 122 prevents fingers getting caught under the roller or too thick cards being placed on the print bed. If an obstruction is encountered, the safety clutch disengages from one side of the chain 118, and engages the other side, so the carriage 24 returns to the starting position. Stops may be positioned on the elongate member to vary the travel distance.

A micro switch 124 is activated by lever 42 to start the printing. An interlock microswitch 126 is provided on one support arm to prevent the gear motor 110 from being started when the elongate arm 18 is not pivoted to the fully closed position.

It has been found that the print roller platen has a longer life when used with the present printing machine due to the fact that it always provides an even pressure across the surface of the cards, and always presses downwards in one place.

Various changes may be made to the embodiments shown herein without departing from the scope of the present invention which is limited only by the following claims.

The embodiments of the invention in which an exclusive property or privilege is claimed are defined as follows:

1. A printing machine for printing on forms of varying thickness from a surface having embossed characters thereon, comprising:

a base;

print bed means on the base for holding embossed printing characters facing upwards;

elongate member having a rectangular cross section, the member positioned above, extending across and parallel to the print bed means and supported from the base;

roller head carriage positioned about the elongate member for reciprocal movement thereon;

print roller platen supported from the center of the carriage beneath the elongate member, adapted to roll in either direction over the embossed printing characters on the print bed means when the carriage moves along the elongate member;

guide frame means within the carriage having two end stabilizer plates supporting four guide rollers in a rectangular configuration positioned therebetween, two of the four guide rollers being top guide rollers rolling on top of the elongate member, and the other two of the four guide rollers being lower guide rollers rolling underneath the elongate member, the two lower guide rollers positioned above the print roller platen equispaced from the center of the carriage and in a triangular configuration with the print roller platen, the four guide rollers restricting tipping of the guide frame means relative to the elongate member;

side guide rollers positioned axially on and at each end of the four guide rollers adjacent the elongate member, the side guide rollers restricting slewing of the guide frame means relative to the elongate member;

the guide frame means attached to the carriage and having limited vertical movement relative to the carriage; and spring bias means pressing the two lower guide rollers vertically upwards against the elongate member, so the print roller platen is at it's lowest position and can move upwards for the limited vertical movement against the spring bias means to take into account different thicknesses of embossed characters and forms, and apply even printing pressure.

2. The printing machine according to claim 1 wherein the base is constructed from square tube with a plate on top, the elongate member is made from a square tube having the same cross section dimension as used in the base.

3. The printing machine according to claim 1 wherein the print bed means has at least one open sided template to accomodate a card having embossed characters thereon, the template permitting the card to be slid into a fixed position for printing, the spring bias means maintaining substantially even printing pressure for different thicknesses of cards.

4. The printing machine according to claim 1 including a slide cover for sliding over edges of the base, the cover having at least one cut-out for holding a card having embossed characters thereon.

5. The printing machine according to claim 1 including mask means for mounting on the print bed means, the mask means having at least one cut-out for holding a card having embossed characters thereon.

6. The printing machine according to claim 5 including adjustable stops attached to the base for providing a guide for positioning a form.

7. The printing machine according to claim 1 wherein the elongate member is supported at both ends by support means from rear corners of the base.

8. The printing machine according to claim 1 wherein the elongate member is cantilevered from a single support means located at a rear corner of the base.

9. The printing machine according to claim 1 wherein the elongate member has a square cross section.

10. The printing machine according to claim 7 wherein the support means are pivoted at the rear corners of the base allowing the elongate member and roller head carriage to be swung open.

11. The printing machine according to claim 10 wherein the elongate member has a locking means to lock the elongate member for continuous printing or transportation of the machine.

12. The printing machine according to claim 1 including a handle on top of the roller head carriage for manual reciprocal movement of the carriage on the elongate member.

13. The printing machine according to claim 10 including motorized means for reciprocally moving the roller head carriage on the elongate member.

14. The printing machine according to claim 13 including a cover means over the motorized means, elongate member and roller head carriage, and including a tripping means on the cover means to activate the motorized means.

15. The printing machine according to claim 1 wherein the spring bias means comprises a leaf spring pushing against the guide rollers underneath the elongate member.

16. The printing machine according to claim 1 wherein the print roller platen is impregnated with ink to print on forms resting on the embossed characters in the print bed means.

* * * * *